US012410572B2

(12) United States Patent
Scuero

(10) Patent No.: US 12,410,572 B2
(45) Date of Patent: Sep. 9, 2025

(54) SYSTEM FOR THE DOUBLE-SEALED CONNECTION OF WATERPROOFING PANELS FOR HYDRAULIC WORKS

(71) Applicant: CARPI TECH B.V., La Etten-Leur (NL)

(72) Inventor: Alberto Maria Scuero, La Etten-Leur (NL)

(73) Assignee: CARPI TECH B.V., La Etten-Leur (NL)

( * ) Notice: Subject to any disclaimer, the term of this patent is extended or adjusted under 35 U.S.C. 154(b) by 267 days.

(21) Appl. No.: 18/040,871

(22) PCT Filed: Aug. 6, 2021

(86) PCT No.: PCT/IB2021/057260
§ 371 (c)(1),
(2) Date: Feb. 7, 2023

(87) PCT Pub. No.: WO2022/029707
PCT Pub. Date: Feb. 10, 2022

(65) Prior Publication Data

US 2023/0304247 A1 Sep. 28, 2023

(30) Foreign Application Priority Data

Aug. 7, 2020 (IT) ..... 102020000019735

(51) Int. Cl.
*E02B 3/16* (2006.01)

(52) U.S. Cl.
CPC ..... *E02B 3/16* (2013.01)

(58) Field of Classification Search
CPC ..... E02B 3/16; E02B 5/02; E02B 7/08; E02B 3/122
See application file for complete search history.

(56) References Cited

U.S. PATENT DOCUMENTS 160,511 A 3/1875 Geobges
5,143,480 A 9/1992 Scuero
(Continued)

FOREIGN PATENT DOCUMENTS

CN 100371539 C 2/2008
CN 109555085 A 4/2019
(Continued)

OTHER PUBLICATIONS

Bangladesh Office Action; Application No. 245/2021/526; Completed: Mar. 24, 2024; Issued: Mar. 28, 2024; 1 Page.
(Continued)

*Primary Examiner* — Sean D Andrish
(74) *Attorney, Agent, or Firm* — Whitmyer IP Group LLC

(57) ABSTRACT

A system for the double-sealed connection of waterproofing panels for lining surfaces of hydraulic works, such as dams, canals, water basins and the like. The system includes a central connection band, made of elastically flexible material and resistant to stress and perforation, whose longitudinal edges are superimposed to the longitudinal edges of continuous waterproofing panels; the system further includes a bottom locking element, an upper locking element superimposable to the previous one, and at least an intermediate sealing gasket, which extend along longitudinal edges of the connection band superimposed to the longitudinal edges of contiguous waterproofing panels; the bottom locking element and the upper locking element include a plurality of axially aligned rectangular compression plates connected by flexible hinges to allow the locking elements to freely adapt against planar and/or irregular surfaces of the surface of the specific hydraulic work to be waterproofed.

16 Claims, 3 Drawing Sheets

(56) References Cited

U.S. PATENT DOCUMENTS

| | | | | |
|---|---|---|---|---|
| 5,806,252 | A * | 9/1998 | Scuero | E02B 3/126<br>405/268 |
| 8,596,927 | B2 * | 12/2013 | Thomson | E02B 3/127<br>52/715 |
| 10,422,096 | B2 | 9/2019 | Scuero | |
| 2005/0050697 | A1 | 3/2005 | Wu | |
| 2006/0234029 | A1 * | 10/2006 | Thompson-Colon | E02D 31/02<br>428/304.4 |
| 2008/0193229 | A1 * | 8/2008 | Graham | E02D 17/20<br>405/302.7 |
| 2011/0176876 | A1 * | 7/2011 | Scuero | E02B 3/16<br>405/259.1 |

FOREIGN PATENT DOCUMENTS

| | | | |
|---|---|---|---|
| EP | 0722016 | * | 7/1996 |
| EP | 3175045 | B1 | 10/2018 |
| FR | 1178216 | A | 5/1959 |
| FR | 2681889 | * | 4/1993 |
| IT | UB20160511 | A1 | 7/2017 |
| WO | 2010028766 | A1 | 3/2010 |
| WO | 2017129627 | A1 | 8/2017 |

OTHER PUBLICATIONS

International Search Report and Written Opinion of the International Searching Authority; Application No. PCT/1B2021/057260; Completed: Oct. 28, 2021; Mailing Date: Nov. 10, 2021; 10 Pages.

* cited by examiner

SYSTEM FOR THE DOUBLE-SEALED CONNECTION OF WATERPROOFING PANELS FOR HYDRAULIC WORKS

TECHNICAL FIELD

The present invention relates to a system or device for sealingly connecting waterproofing panels, generally known as "geomembranes", used for forming waterproofing linings in hydraulic works such as dams, water basins, canals and similar hydraulic works covered with cement or bituminous concrete, masonry, shotcrete, melted material.

BACKGROUND

The waterproofing of hydraulic works, in particular dams and canals, which is necessary to avoid dangerous water losses resulting in economic damages and the risk of compromising the stability of the dam or hydraulic work in general, is carried out by anchoring to the wall contacting or facing the water, a waterproofing lining consisting of a plurality of flexible panels made of a geosynthetic material, such as polyvinyl chloride (PVC) or other thermoplastic material suitable to contact the water, the liner and the wall of the hydraulic work.

Waterproofing panels are generally fastened to the surface of the hydraulic work to be protected by means of different anchoring mechanical systems, which require time-consuming and expensive operations for preparing the contacting surface of the hydraulic work, as well as expensive and time-consuming assembly of the panels.

In general, suitable metal anchoring profiles which extend parallel to a longitudinal direction of the waterproofing panels have been used for laying and fastening the waterproofing panels, as disclosed and shown for instance in U.S. Pat. No. 5,143,480 and WO 2017/129627. According to these known systems, pairs of long rigid metal profiles are generally used, with an omega- or C-shaped cross section, or also flat, wherein superimposed edges of contiguous waterproofing panels and a suitable sealing gasket are locked between an upper metal profile removably fastened to a bottom metal profile, in turn fastened to the wall of the hydraulic work to be waterproofed. However, long rigid metal profiles cannot be easily laid on flat surfaces of the hydraulic work, i.e., in case of irregular surfaces, the prior application of a cement mortar support is required to locally create a regular support surface.

Furthermore, the body of any hydraulic work, such as a dam embankment or canal banks, undergo settlement movements or movements caused by landslides or earthquakes, with consequent permanent deformation of the anchoring metal profiles and loss of hydraulic seal. Furthermore, in those cases wherein the surface to be waterproofed has different slopes or possible steps, or significant roughness, the use of long rigid metal profiles may be a problem or may even be impossible or difficult to be applied.

While attempting to overcome such drawbacks, for the purpose of joining the waterproofing lining panels made of geosynthetic material for hydraulic works, the use of waterproofing zips has been proposed, such as of the type disclosed in US 2005/0050697, or as disclosed in U.S. Pat. No. 10,422,096.

The use of waterproofing zips allows to easily connect the several waterproofing panels that continuously bear the permanent hydraulic load, with no need to empty the dam or to stop the water flow in the canal.

Waterproofing zips provide a proper functioning if they are installed on a regular surface as they tend to adapt to the support surface. In case the support surface has cavities or protruding parts, while adapting to the support shape, transversal strains may occur in the waterproofing zip, which act on the rigid connection of the zip teeth compressing a thin sealing gasket; the teeth, moving away from each other, cause water leakage with a resulting loss in the waterproofing function. Therefore, in case of irregular surfaces, or if slits occur during the service life due to seismic events or differential settlements thus causing a deformation of the support surface, a discontinuity, and possible misalignments, the zip waterproofing connection function fails to occur.

SUMMARY

The object of the present invention is to make available a new and different solution which makes it possible to solve such problem, providing double-sealed connection conditions between waterproofing panels, suitable to overcome the previously reported drawbacks, always maintaining sealing conditions.

Another object of the invention is to provide a solution that makes it possible to easily install the waterproofing panels, in a comparably short time, suitable both for underwater and dry application, on any type of waterproofing panel support surface, including masonry hydraulic works with large-size stones and significant roughness.

The problem has been solved by a double-sealed connection system between waterproofing panels for lining hydraulic works, as described below.

The connection system includes in particular:

- a central connection band between contiguous waterproofing panels, made of waterproofing and elastically flexible or deformable material, having features of resistance to external stress and perforation when laid on surfaces with a high roughness, discontinuity, misalignments, etc. which are comparatively greater than those of the waterproofing panels, wherein the band is configured with longitudinal edges superimposable to the longitudinal edges of the waterproofing panels;
- a bottom elongated locking element, an upper elongated locking element that can be superimposed on the bottom elongated locking element, and an intermediate sealing gasket, wherein the upper and bottom elongated locking elements and the sealing gaskets extend along the longitudinal edges of the central connection band;
- wherein each elongated locking element includes a plurality of short axially aligned modular compression plates;
- at least one disengageable connecting member between each modular plate of the bottom locking element and a corresponding modular plate of the upper locking element;
- wherein the axially aligned modular plates of the bottom locking element and of the upper locking element are connected by flexible hinges.

BRIEF DESCRIPTION OF THE DRAWINGS

An embodiment of the invention will now be described with reference to the example in the enclosed drawings wherein.

DETAILED DESCRIPTION

Figure 1:
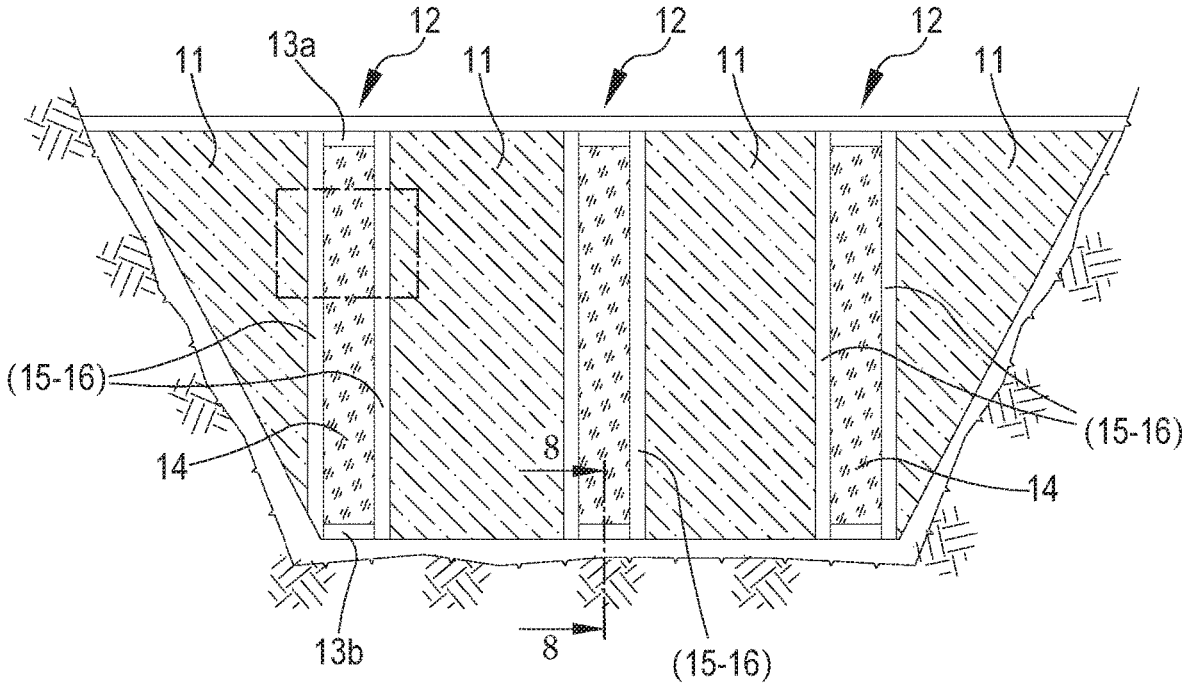
FIG. 1 is a view from the upstream side of a general dam, wherein waterproofing contiguous panels are connected between each other by a double-sealed connection system, according to the invention.

In FIG. 1 an upstream side of a general dam 10 is shown, whose water facing surface is provided with a waterproofing lining consisting of a plurality of waterproofing panels 11 made of geosynthetic material, wherein contiguous panels 11 are sealingly joined with each other by a double-sealed connection system 12, which is shown and hereinafter described with reference to the other Figures. For the purposes of the present invention, the term "geosynthetic material" refers to any flexible and extensible sheet made of thermoplastic material, such as polyvinyl chloride (PVC) or other synthetic material suitable for the contact with the ground or other materials such as concrete, normally called "geomembrane".

Figure 4:
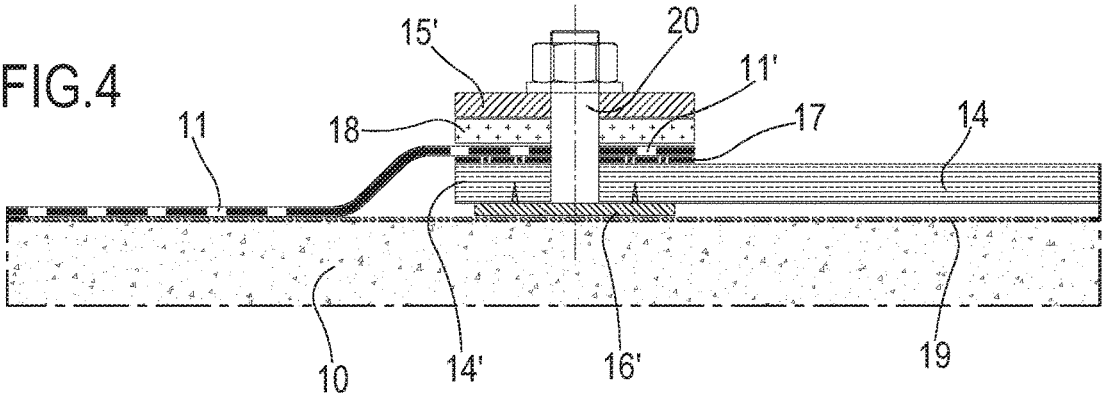
FIG. 4 is an enlarged cross section, according to line 4-4 of FIG. 2.
Figure 5:
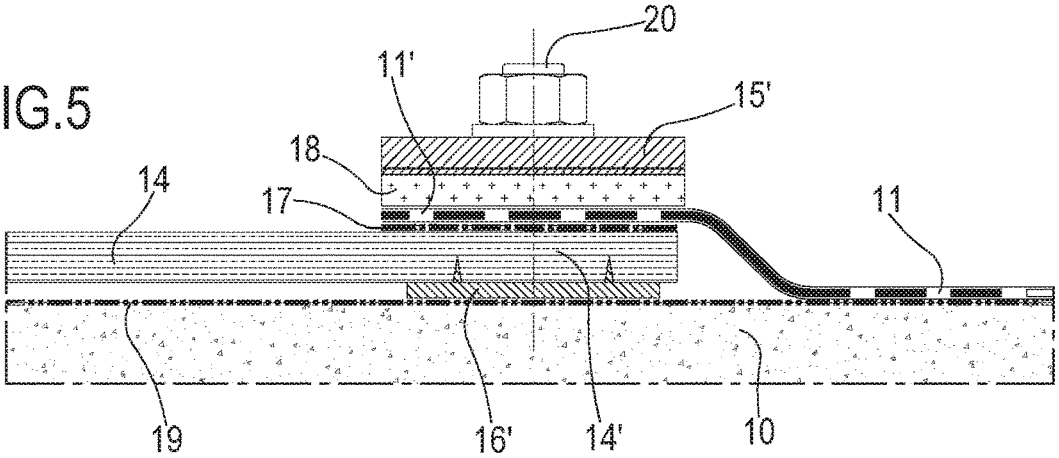
FIG. 5 is an enlarged cross section, according to line 5-5 of FIG. 2.

The connection system 12, as shown in the various Figures, includes a central connection band 14, whose longitudinal edges 14' are sealingly superimposed to respective longitudinal edges 11' of two contiguous waterproofing panels 11, as shown in the details of FIG. 4 and FIG. 5. The central connection band 14 consists of an elastically flexible or deformable sheet material such as rubber, synthetic fibre-reinforced rubber, metal wires or other reinforcement material consisting in a synthetic resin, such as selected from the following: polyethylene, polyester, polypropylene, or combinations thereof.

The central connection band 14 generally consists of robust material, though at the same time flexible and/or elastically deformable, including sheets made of copper, steel or suitable material, having features of resistance to external stress and perforation that are comparatively greater than those of the material of the waterproofing panels 11.

The central connection band 14 may be of any size in length, width and thickness, such as a width between 200 mm and 600 mm, and a thickness between 3 mm and 20 mm depending on the material used and the mechanical or structural characteristics thereof.

Figure 3:
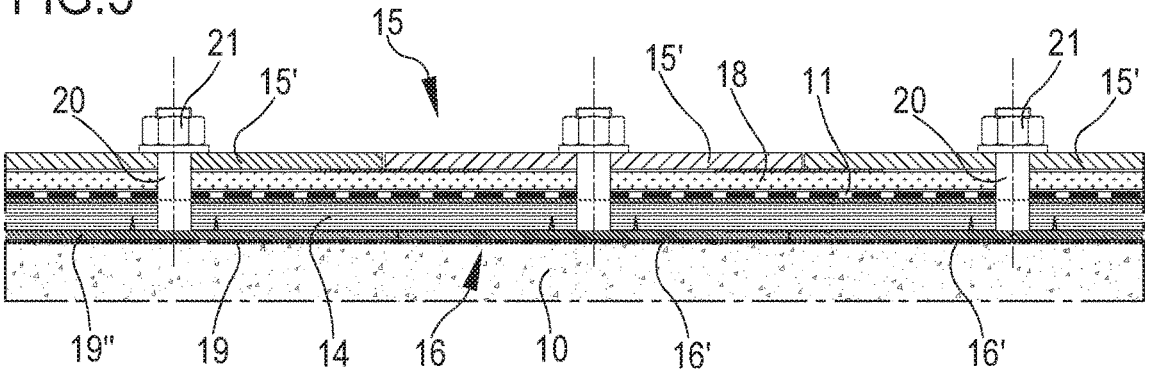
FIG. 3 is an enlarged longitudinal section, according to line 3-3 of FIG. 2.
Figure 6:
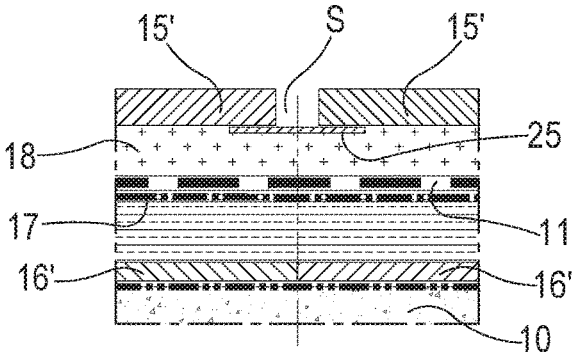
FIG. 6 is an enlarged detail of FIG. 3.

As shown in FIG. 1 and in FIGS. 3 and 6, the double-sealed connection system 12 further includes a first bottom elongated locking element 15 and a second upper elongated locking element 16 superimposable and connectable in a disengageable way to the bottom elongated locking element 15 along each longitudinal edge 14' of the central connection band 14. The elongated elements 15 and 16 of each connection system 12 are further connected at their upper and lower ends by means of transversal plates 13A and 13B, as schematically shown in FIG. 1; therefore, for what will be hereinafter explained, the assembly of the upper elongated locking elements 15 with the relative transversal plates 13A and 13B, create a sort of articulated rectangular frame; similarly for the bottom elongated locking elements 16 and the related transversal plates.

A compressible sealing gasket 18 is interposed between the upper locking element 15 and a longitudinal edge 11' of a corresponding waterproofing panel 11; the sealing gasket 18 may be made of any synthetic rubber, with a width between 30 mm and 100 mm, and a thickness between 3 mm and 18 mm or higher, depending on the length of the modulus of elasticity of the upper locking element 15. Furthermore, a possible double-faced adhesive tape 17 may be interposed between each longitudinal edge 11' of the waterproofing panel 11 and each longitudinal edge 14' of the central connection band 14.

As shown in the enlarged detail of FIG. 2 and in the following ones, each upper 15 and bottom 16 elongated locking element consists of a plurality of short modular compression plates 15', 16' respectively, that are flat or configured otherwise, wherein each upper modular compression plate 15' is superimposed and connectable in a disengageable way to a bottom corresponding modular compression plate 16' to sealingly compress the superimposed edges 11', 14' of the panels 11 and of the connection band 14 between each other, and the sealing gasket 18, maintaining an even distribution of the pressure regardless of a possible flexion of the locking elements 15, 16 and of the relative position that each pair of upper and bottom modular compression plates superimposed between each other 15', 16' can assume with respect to the others, due to possible breaks or deformation undergone by the hydraulic work over time.

The upper modular plates 15' and the lower modular plates 16' are structurally rigid and can be made with any suitable material; for example, they may be made of steel or other metal material, glass or carbon fibre, plastic material or a combination thereof. Furthermore, the axial length of the upper 15' and lower 16' modular plates may be of any size or thickness, depending on the specific design requirements.

For instance, the axial length of the upper 15' and lower modular plates 16' may be between 100 mm and 250 mm, slightly lower or higher; the thickness may be between 2 mm and 10 mm and the width between 30 mm and 100 mm.

The central connection band 14 may be in turn of any desired length and may have a length between 200 mm and 600 mm, slightly lower or higher, and a thickness between 3 mm and 20 mm.

As a particularly innovative feature and as initially specified, the modular plates 15' and the modular plates 16' of the various elongated elements 15 and 16 for locking the waterproofing panels 11 and the connecting band 14 are mutually connected by flexible hinges which make the entire connecting system composed by locking elements 15 and 16 configured with a plurality of flexible joints which allow the entire connection system to fit any surface to be waterproofed, thus preventing the connection band 11 from penetrating into slits or cracks of the support surface due to possible seismic events or differential settlements which can result, over time, into a deformation of the support surface.

The flexible hinge connection between the modular plates 15' and 16' of the two elongated locking elements 15, 16 may be made in any suitable way; in the specific case of the solution shown, the flexible hinge function is performed by longitudinal edges 15', 16' of the central connection band 14 due to its elastic flexion or deformation features.

It must also be specified that between the surface of the hydraulic work 10 to be waterproofed, the lining made of waterproofing material 11 and the connection band 14, a support layer 19 may be interposed, such as a geotextile having a high stretching resistance, typically consisting of synthetic material fibres such as polyethylene, polyester, polypropylene or combination thereof, to prevent the lining from possibly entering a crack or slit of the hydraulic work 10.

It was stated that each upper modular plate 15' is removably fastened to a corresponding upper modular plate 16', by providing suitable connection members that can be engaged and disengaged between each other.

According to one first embodiment, shown in the FIGS. 2 to 5, the connection members between each bottom modular plate 16' and the corresponding upper modular plate 15' include at least a threaded pin 20 welded to the lower modular plate, which passes through holes prearranged in the longitudinal edges of the waterproofing panels 11, in the longitudinal edge of the central connection band 14 and in the sealing gaskets 18; a nut 21 can be screwed on the threaded pin 20 with a suitable tightening torque, so as to suitably compress the sealing gasket 18.

Figure 7:
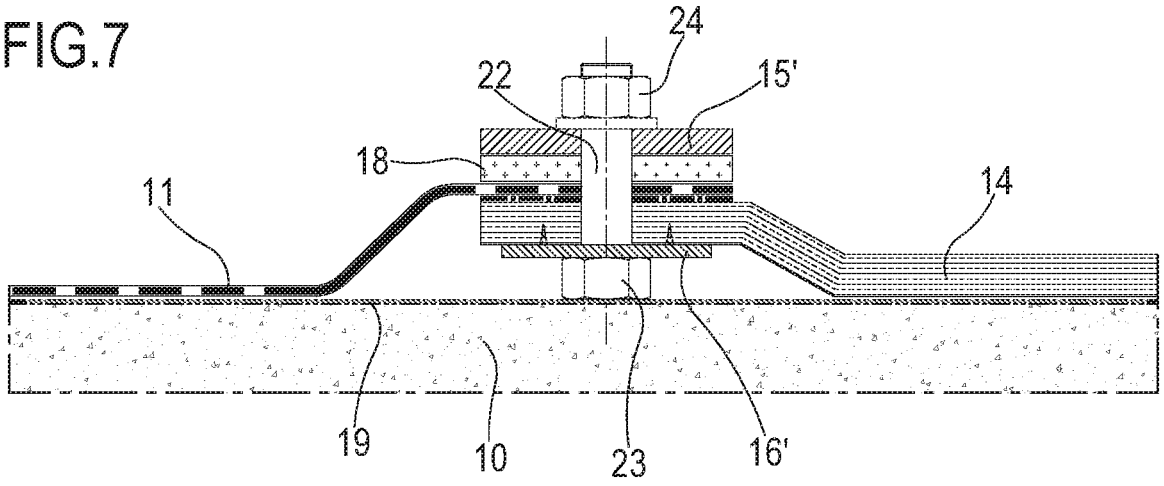
FIG. 7 shows an enlarged detail of a variant of the connection member between modular plates.

According to another possible solution, each connecting member between lower modular plates 16' and upper modular plates 15', as shown in FIG. 7, may consist of a bolt 22 whose lower head 23 is fastened, for instance welded to the bottom modular plate, wherein the threaded stem of the bolt 22 passes through holes arranged in the bottom modular plate 16', in the longitudinal edge 14' of the central connection band 14, in the possible dual-faced adhesive tape 17, in the longitudinal edge 11' of the waterproofing panels 11, in the sealing gasket 18 and in the upper modular plate 15', providing, in this case as well, a clamping bolt 24.

FIG. 6, wherein the same reference numbers have been used to refer to similar or equivalent parts, shows the use of a thin continuity plate 25, interposed between contiguous upper modular plates 15' and the underlying sealing gasket 18, at a slit S which can be formed while assembling the system between the modular plates; in general the continuity plate 25 may have a thickness between 0.5 mm and 3 mm, a width between 2 mm and 8 mm, and a length between 30 mm and 100 mm, depending on the size of the upper modular plates 15' and on the width of the slit S between the modular plates, which can vary between 1 mm and 5 mm. The continuity plate 25 has the function to ensure the proper compression of the sealing gasket 18.

Figure 8:
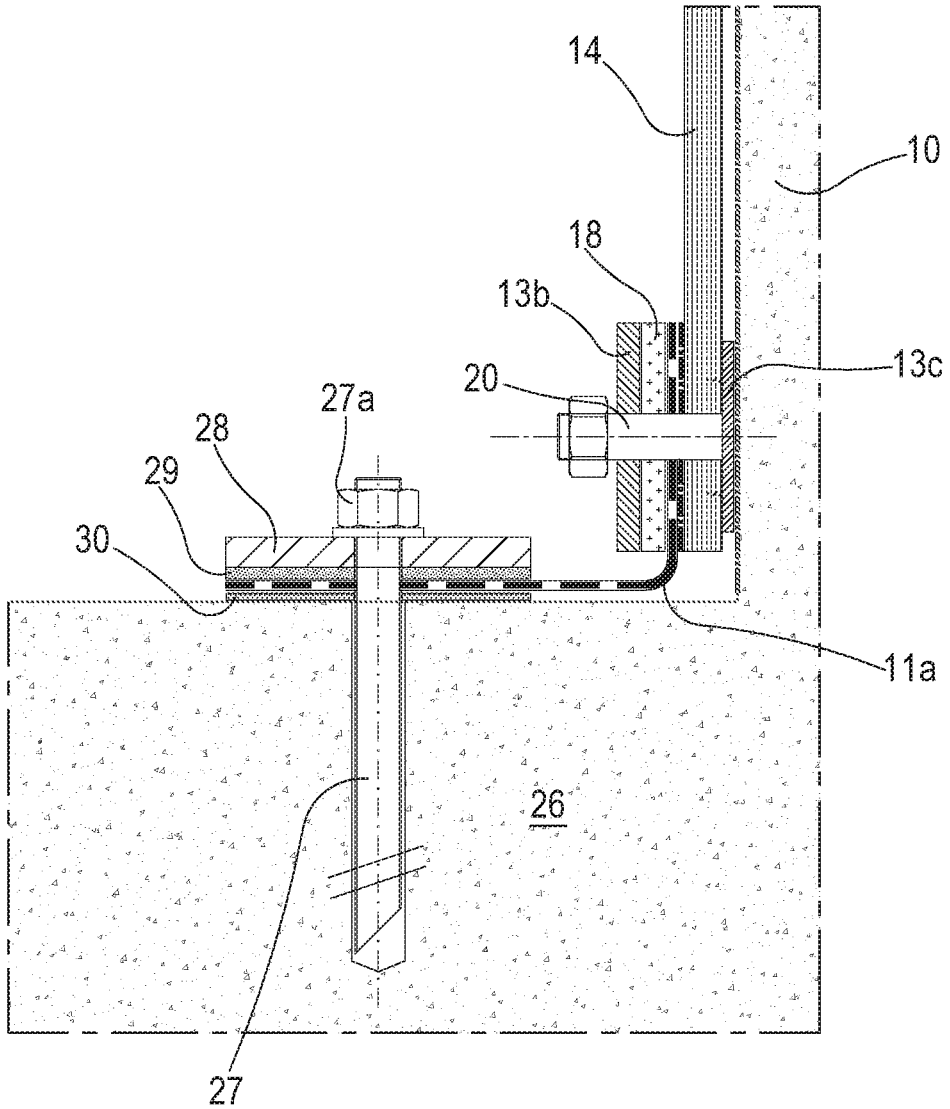
FIG. 8 is an enlarged cross section, according to line 8-8 of FIG. 1.

Finally FIG. 8 shows, by way of example, how water sealing is obtained between the central connection band 14, at the bottom transversal plate 13B which normally is below the level of water, and a base plinth 26. Sealing towards the wall of the hydraulic work at the bottom end of each connection system of FIG. 1, consists in a waterproofing band 11A substantially corresponding to waterproofing panels 11, sealingly locked between the front plate 13B and a rear plate 13C, the central connection band and a sealing gasket 18; the sealed band 11A is in turn fastened to the base plinth 26 by a common anchoring pin 27, a metal disc 28 and two gaskets 29 and 30 on opposite faces of the band 11A.

Figure 2:
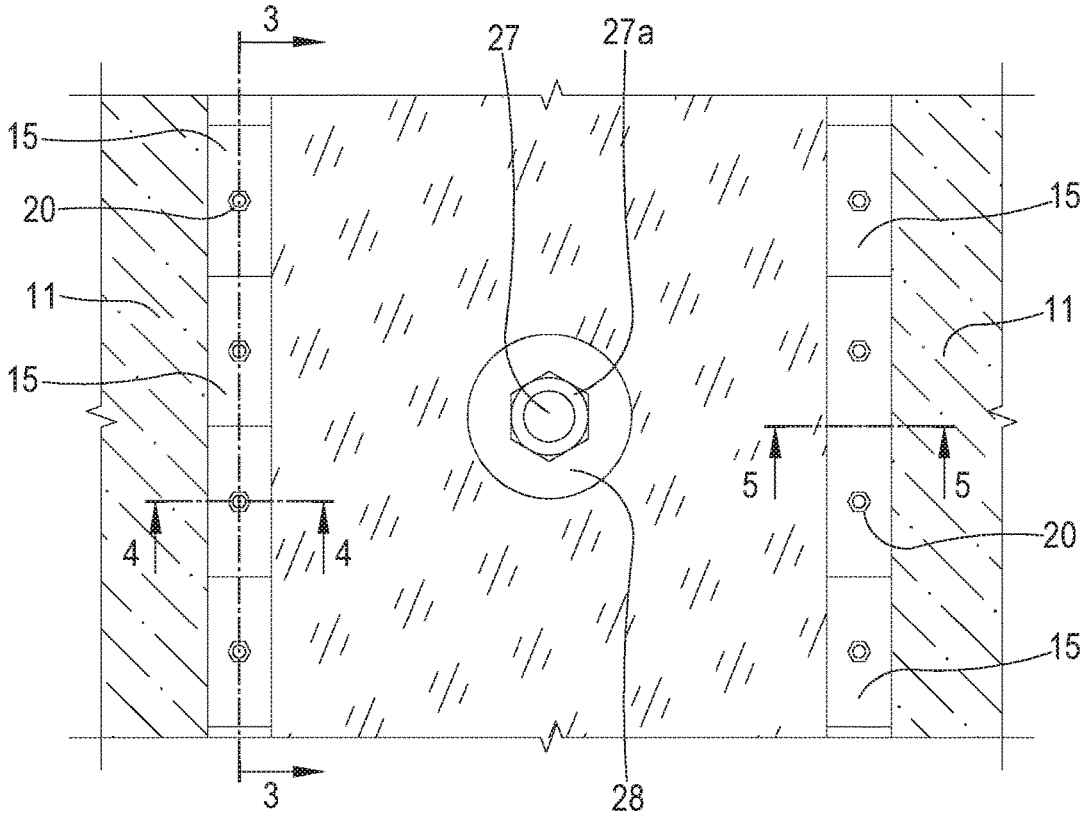
FIG. 2 is an enlarged detail of FIG. 1.

Finally, still referring to FIG. 2, reference numbers 27, 27A and 28 indicate, for exemplary purposes, a possible anchoring in one or more positions of the central connection band 14 to the hydraulic work to be waterproofed.

The invention claimed is:

1. A sealed connection system between waterproofing panels suitable for lining a wall of hydraulic works, comprising elongated locking elements for locking the waterproofing panels a central waterproofing connection band between the contiguous waterproofing panels, the central waterproof connection band being made of elastically flexible or yieldable material, the central waterproofing connection band having features of resistance to stress and perforation that are comparatively greater than features of resistance to stress and perforation d perforation of the waterproofing panels;

the elongated locking elements including a bottom elongated locking element and an upper elongated locking element for locking longitudinal edges of the central waterproofing connection band to longitudinal edges of the waterproofing panels, at least one intermediate sealing gasket, that extends along the longitudinal edges of the central waterproofing connection band;

in which each of the elongated locking elements includes a plurality of axially aligned modular compression plates;

at least one disengageable connecting member between each modular compression plate of the bottom locking element and a corresponding modular compression plate of the upper locking element; and in which axially aligned contiguous modular compression plates of the upper and bottom locking elements are connected together by flexible hinges, each flexible hinge consisting of one of the longitudinal edges of the ventral waterproofing connection band, the flexible hinges making the elongated locking elements configured with a plurality of flexible joints which allow the entire connection system to fit a surface to be waterproofed, thus preventing the central waterproofing connection band from penetrating into slits or cracks of the surface.

2. The connection system according to claim 1 wherein the at least one intermediate sealing gasket is interposed between the modular compression plates of the upper locking element and one of the longitudinal edges of the central connection band.

3. The connection system according to claim 1, wherein at least one anchoring element is provided for anchoring the central connection band to the wall of the hydraulic work.

4. The connection system according to claim 1, wherein the lower modular plates are provided with a plurality of pointed elements suitable for partially penetrating into the longitudinal edges of the central connection band.

5. The connection system according to claim 1, wherein the at least one disengageable connecting member consists of a threaded pin fastened to each modular compression plate of the bottom locking element.

6. The connection system according to claim 1, wherein the at least one disengageable connecting member consists of a bolt passing through axially aligned holes of each modular compression plate of the bottom locking element, respectively of each modular compression plate of the upper locking element.

7. The connection system according to claim 1, wherein a single connecting member is positioned in each of the modular compression plates of the bottom locking element.

8. The connection system according to claim 1 wherein the central connection band is configured with a width between 200 mm and 600 mm, and a thickness between 3 mm and 20 mm.

9. The connection system according to claim 1 wherein the compression plates are configured with a length between 100 mm and 250 mm, a width between 30 mm and 100 mm, and a thickness between 2 mm and 10 mm.

10. The connection system according to claim 1, wherein the at least one intermediate sealing gasket is configured with a width between 30 mm and 100 mm, and with a thickness between 3 mm and 18 mm.

11. The connection system according to claim 1, wherein the contiguous compression plates of the locking elements are spaced apart by a gap having a width between 1 mm and 5 mm.

12. The connection system according to claim 1, wherein the compression plates of the bottom locking element have a plurality of pointed elements towards the central connection band.

13. The connection system according to claim 1, wherein a double-faced adhesive tape is interposed between the longitudinal edges of the waterproofing panels and of the central connection band.

14. The connection system according to claim 1, wherein a plate for continuity of the compression is interposed between the contiguous compression plates of the upper locking element and the at least one intermediate sealing gasket.

15. The connection system according to claim 1, wherein the central connection band consists of a material selected from: rubber, reinforced rubber, polymeric material, metal, and combinations thereof.

16. The connection system according to claim 1, wherein the compression plates consist of a material selected from: steel, synthetic resin, synthetic resin with glass fibres, and synthetic resin with carbon fibres.

* * * * *